US006059620A

United States Patent [19]

Yetman

[11] Patent Number: 6,059,620

[45] Date of Patent: May 9, 2000

[54] ARRANGEMENT FOR MINIMIZING THE EXPLOSION POTENTIAL IN MOORED TURRETS FOR HYDROCARBON STORAGE VESSELS

[75] Inventor: Richard D. Yetman, Tomball, Tex.

[73] Assignee: FMC Corporation, Chicago, Ill.

[21] Appl. No.: 09/329,521

[22] Filed: Jun. 10, 1999

Related U.S. Application Data

[60] Provisional application No. 60/088,973, Jun. 11, 1998.

[51] Int. Cl.[7] ..... B63B 22/02

[52] U.S. Cl. ..... 441/4; 114/230.12

[58] Field of Search ..... 114/230.12, 230.13; 441/3–5

[56] References Cited

U.S. PATENT DOCUMENTS

| | | | |
|---|---|---|---|
| 4,604,961 | 8/1986 | Ortloff et al. | 114/230.12 |
| 4,765,378 | 8/1988 | Engelskirchen et al. | 114/230.12 |
| 5,339,760 | 8/1994 | Korsgaard | 441/3 |
| 5,564,957 | 10/1996 | Breivik et al. . | |
| 5,823,131 | 10/1998 | Boatman et al. | 114/230.12 |

*Primary Examiner*—Sherman Basinger

*Attorney, Agent, or Firm*—Gary L. Bush; Mayor, Day, Caldwell & Keeton, L.L.P.

[57] ABSTRACT

An improved arrangement for connection of a disconnectable spider buoy to an internal turret of a floating production storage and off loading vessel is disclosed. Risers from subsea wells are connected by quick disconnect/connection devices to pipes which run through the turret and then via a product swivel to lines leading to storage tanks on the vessel. A structure is provided to create an enclosed space to enclose the connection devices at the top of the spider buoy. A ventilation shaft runs from the enclosed volume to atmosphere via the top of the turret. A forced air line is provided into the enclosed space for ventilating the space via the ventilation shaft during normal operations. If a gas leak is sensed in the enclosed space, the forced air line is closed. The small volume which surrounds the connection devices quickly fills with hydrocarbon gas to produce a high gas/air ratio in the enclosed space which greatly reduces danger of explosion.

7 Claims, 3 Drawing Sheets

100
52
40
40
40
40
36
36
36
16

ARRANGEMENT FOR MINIMIZING THE EXPLOSION POTENTIAL IN MOORED TURRETS FOR HYDROCARBON STORAGE VESSELS

REFERENCE TO PRIOR APPLICATION

This application claims priority from prior Provisional Application No. 60/088,973 filed Jun. 11, 1998.

BACKGROUND OF THE INVENTION

1. Field of the Invention

This invention relates generally to floating hydrocarbon storage vessels connected to subsea wells and particularly to such storage vessels having a turret anchored to the sea floor with the storage vessel weathervaning about the turret.

2. Description of the Prior Art

In mooring systems for floating vessels used in the development of offshore oil resources, a turret anchored to the sea floor and mounted within an opening in the hull of the floating vessel is often used where the vessel weathervanes about the turret. Product risers extend from the subsea wells to the turret and are connected to pipelines in a lower portion or shaft of the turret for transfer of hydrocarbon product to storage areas of the vessel. The product risers which extend to subsea wells, or manifolds for such wells are often supported by a spider buoy which is releasably connected to the turret; pipeline connections are made between the spider buoy and turret for the transfer of product. Hydrocarbon-based gases which can be released by these pipeline connections are highly explosive if a certain gas/air mixture is present. This gas/air ratio is between 1% and 17% hydrocarbon gas to air. The lower turret shaft generally has an open volume within the ship that is largely confined on virtually all sides. This large volume combined with the tight confinement (lack of ventilation) has the potential of generating very high blast over pressures were an explosion to occur.

SUMMARY OF THE INVENTION

In the area where the flexible subsea risers from the subsea wells are connected to piping on the turret, a reduced volume is provided according to the invention to surround these connections. This area is sealed off from the rest of the lower turret in order to impede the migration of any leaked gas to the larger volume of the lower turret. A free flowing ventilation shaft is also provided from this confined space to the upper extremity of the turret which is open to the atmosphere. As a result of the relatively small sealed-off area as may be provided between a spider buoy and a turret, any gas leaks will quickly saturate the small volume with a gas/air mixture which is too rich to ignite. Thus, the smaller volume or area remains in the explosive range a relatively small time period. Free venting to the upper extremity of the turret will also eliminate any pressure build up in this area. Thus, if an explosion were to occur, the volume of trapped gas is much smaller than in prior designs. The smaller volume greatly reduces the possibility of damage due to blast over pressure. The small sealed off area is also provided with a forced air ventilation system which can be used to provide fresh air if the area needs to be accessed by personnel.

Other objects and features of this invention will be apparent from the following specification and drawings.

DESCRIPTION OF THE INVENTION

Figure 1:
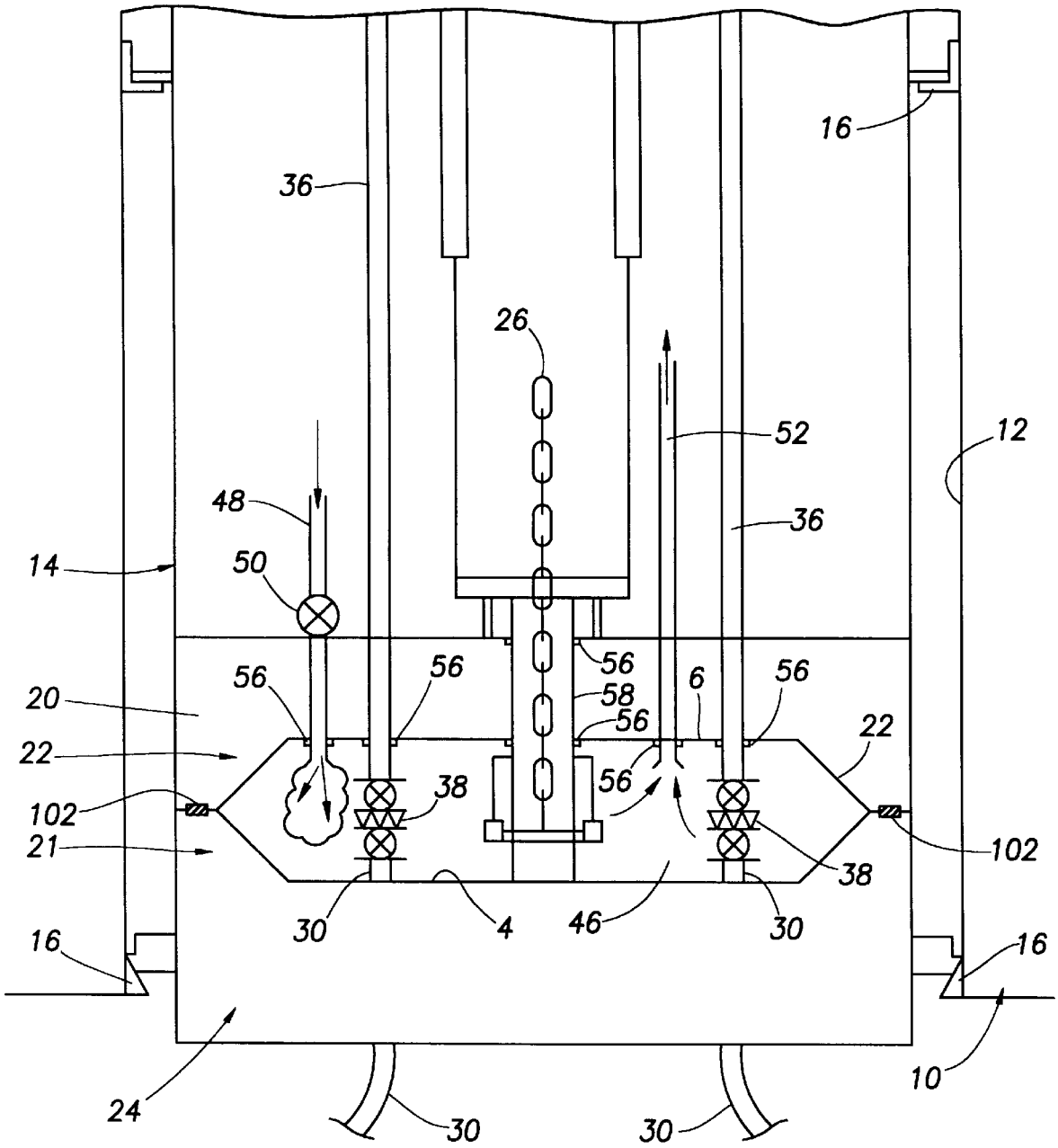
FIG. 1 is a schematic of the present invention showing venting means for venting the lower turret shaft and a relatively small lower turret area or chamber in which the product risers from a spider buoy are connected to the turret pipelines for transfer of product to suitable storage areas of the vessel.

Referring to the drawings, an arrangement for minimizing the explosion potential in moored turrets for a hydrocarbon storage vessel is shown schematically with the floating storage vessel shown at 10 having a vertical opening 12 extending through its hull. A turret generally indicated at 14 is mounted within opening 12 on upper and lower bearing assemblies 16 to permit weathervaning of vessel 10 about turret 14. Anchor legs 18 as shown in FIG. 2B are connected to buoy 24 and are anchored to the sea floor. When the buoy 24 is secured to turret 14, the anchor legs prevent rotation of turret 14. Alternatively, the anchor leg may be reasonably secured directly to the turret 14. In the preferred embodiment as illustrated, the lower end portion 20 of turret 14 has a lower cavity defined by sidewalls 22 and a horizontal partition 6 in which a spider buoy generally indicated at 24 is releasably mounted in a docked position.

Spider buoy 24 is pulled by chain 26 into docking position within turret 14 as shown particularly in FIG. 2B. Alignment pins 28 align spider buoy 24 for docking. Cooperating locking means on turret 14 and spider buoy 24 releasably lock spider buoy 24 to turret 14. Risers 30 suspended from spider buoy 24 extend to subsea wells on the sea floor. Umbilicals 32 for hydraulic fluid and electrical cable are also carried by spider buoy 24. Pipe lines 36 within turret 14 are connected by quick disconnect devices (QCDC) 38 to risers 30. Pipe lines 36 extend to upper manifolds 40 for transfer via a product swivel 100 to suitable storage areas within vessel 10. Suitable quick disconnect devices 42 are also provided to connect umbilicals 32 to suitable supply lines 44.

Figure 2A:
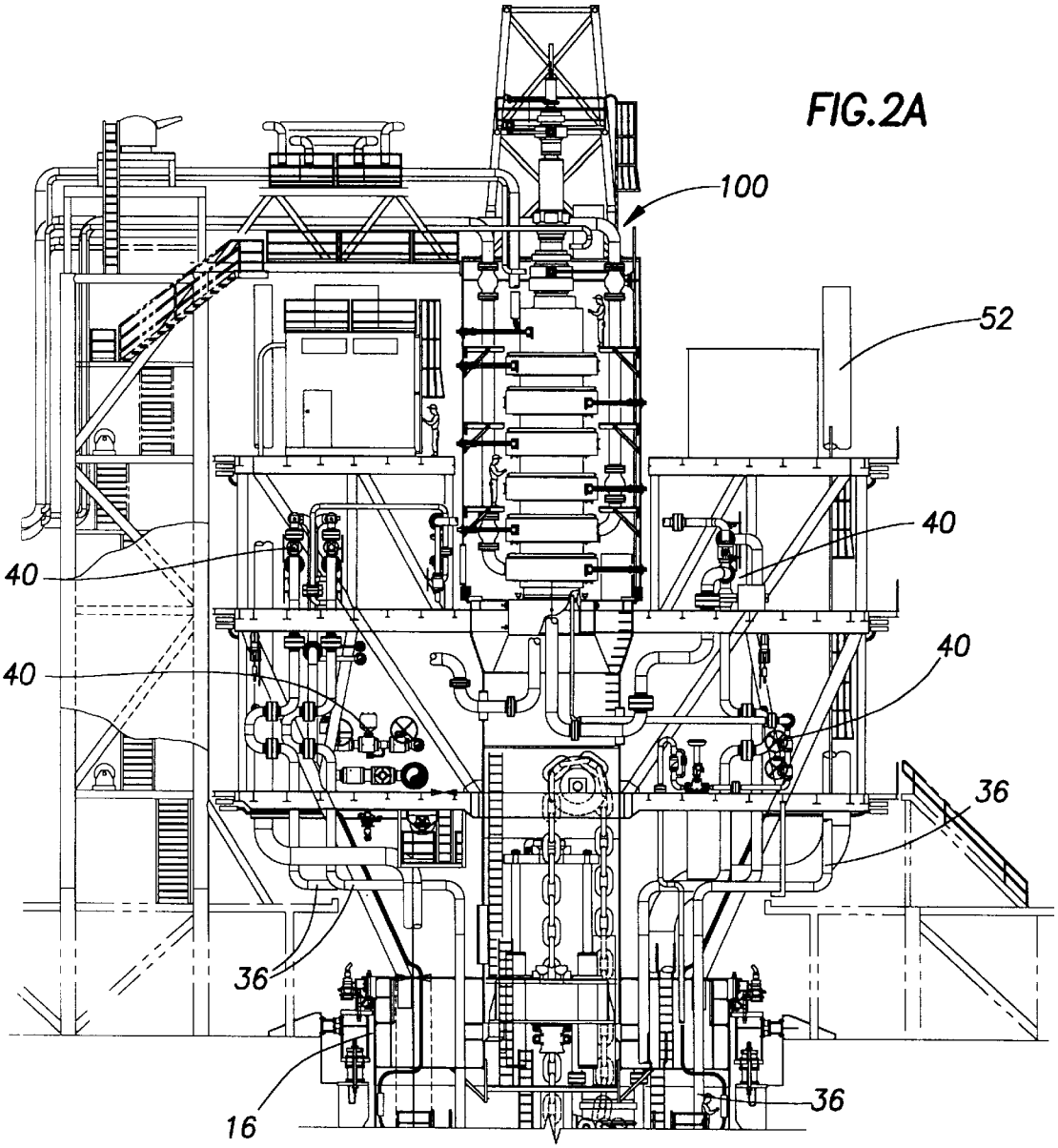
FIGS. 2A and 2B is a sectional view of a portion of a vessel having a turret anchored to the sea floor and including a spider buoy removably coupled to the turret with risers carried by the spider buoy which are releasably connected to pipes for transferring product to the vessel storage areas.
Figure 2B:
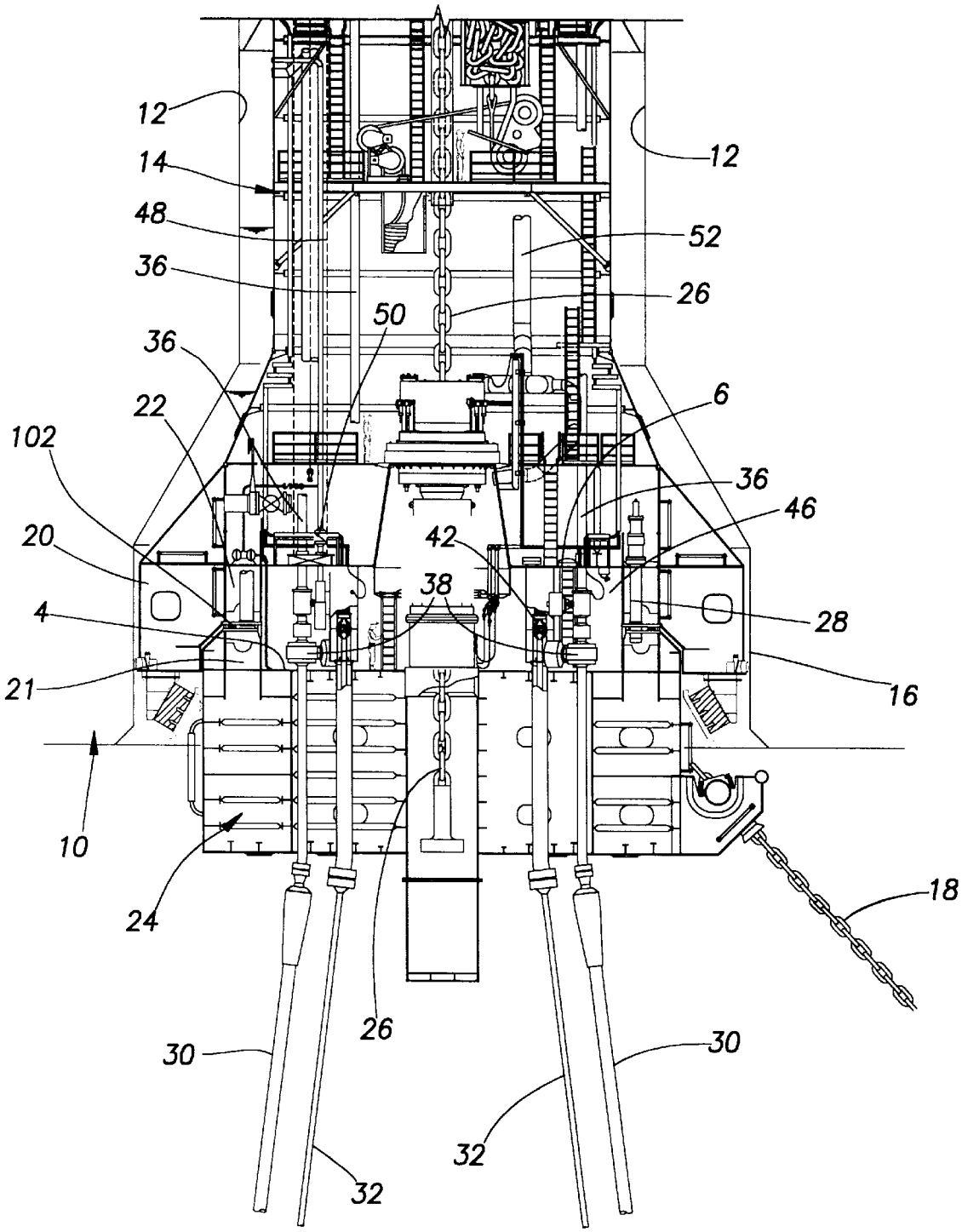

As shown in FIGS. 1, 2A and 2B, a relatively small confined space or volume 46 is provided between spider buoy 24 and turret 14 in the docked position of buoy 24. The space or volume 46 is defined by the top 4 of the spider buoy 24, the sidewalls 22 and 21 of the lower turret and spider buoy and a horizontal partition 6 at the bottom end of the turret 14. An air supply line 48 extends to space 46 through the partition 6 and is controlled by valve 50. A seal 56 between line 58 and a hole in partition 6 substantially prevents gaseous discharge via partition 6.

A vent line 52 extends from space 46 to atmosphere adjacent the upper end of a swivel stack 100. A seal 56 between vent line 52 and a hole in partition 6 substantially prevents gaseous discharge via the hole for vent line 52 in partition 6. Confined space 46 is provided for workmen for connection of the risers 30 at the quick disconnect devices 38 upon docking of buoy 24. To prevent or minimize the flow of air into confined space 46 or the discharge of any hydrocarbon gas therefrom, suitable seals 56 are also provided about pipe lines 36 and about the housing 58 for a hydraulic latching device and in which pull-in chain 26 is received, particularly as shown in FIG. 1. Seals may also be provided between the risers 30, umbilicals 32 and the hydraulic connector housing at the top of the spider buoy. Such seals at the top 4 of the spider buoy are not as essential as those in the partition 6, because gas leakage at the top of the buoy 24 is not likely to accumulate in the main interior cavity of the turret. The areas 102 between mating surface of sidewall 22 of the lower turret and sidewall 21 of the spider buoy are also equipped with seals. Thus, any gas leaks at the location of quick disconnect devices 38 or other areas located within confined space 46 will quickly saturate the relatively small space or volume 46 with a gas/air mixture above the explosive ratio of 1.5% to 16.5% hydrocarbon gas to air.

The range of 1.5% to 16.5% specified here is a general reference for the explosive ratio of hydrocarbon gas to air mixtures used in the oil and gas industry as defined by the table below. The general range of 5% to 15% is a "general" range recognized by the oil and gas industry. However, explosive hydrocarbon gas mixtures depend on the exact air/gas mixture of individual gases. For example, the following table of specific gasses illustrates the air/gas upper and lower explosion ratios for specific hydrocarbon gases.

| Gas | Lower Air/Gas Explosive % | Upper Air/Gas Explosive % |
|---|---|---|
| Methane | 4.4 | 16.5 |
| Ethane | 2.9 | 13.0 |
| Propane | 2.0 | 9.5 |
| N-Butane | 1.5 | 9.0 |
| I-Butane | 1.8 | 8.4 |

The small size of volume 46 which surrounds a possible hydrocarbon leak source has another advantage. If an explosion were to occur, only a relatively small volume of trapped gas is involved which reduces the possibility of damage. If a gas leak were to occur, the time that space 46 is in the explosion range is a relatively small time, because space 46 is of minimal size and sealed off from air sources or supply. Vent 52 extends upwardly to the upper end of the swivel stack and is open to atmosphere. Vent 52 prevents any pressure build-up in space 46.

In operation, upon docking of spider buoy 24, quick disconnects 38 are made by workmen in space 46. Forced air is provided to space 46 through line 48 and forced out of vent 52 for ventilation. Upon detection of gas in space 46, air supply line 48 is closed with space 46 venting naturally to atmosphere. Because space 46 is relatively small, it will quickly pass the 15% ratio of gas to air without any ignition sources and space 46 rapidly becomes gas rich. After passing the 15% ratio with space 46 air sealed, the danger of explosion is greatly reduced.

While FIGS. 2A and 2B do not show specific seals 56 as illustrated generally in FIG. 1, suitable seals 56 for tubular members as well known may be provided. While quick disconnects 38 are illustrated as being operated manually, it is to be understood that quick disconnects 38 may be operated remotely in some instances. As a result of the relatively small sealed-off space 46, the upper portion of the turret 14 is protected from possible blast over pressures because of an explosion were to occur, it would be limited to space 46.

While a preferred embodiment of the present invention has been illustrated in detail, it is apparent that modifications and adaptations of the preferred embodiment will occur to those skilled in the art.

What is claimed is:

1. An improved mooring system having an internal turret (14) which is rotatably supported on a vessel and includes a spider buoy (24) arranged and designed for releasable connection to a bottom end of said turret and where said spider buoy carries a riser (30) arranged and designed to transport hydrocarbon products from a subsea source of hydrocarbon product to said vessel and where said turret includes a pipe (36) connected to said riser by a connection device (38), wherein the improvement comprises, a structure which defines an enclosed space at the bottom end of said turret and above said top surface of said buoy, said enclosed space being formed by a partition (6) at said bottom end of said turret (14), said top end (4) of said spider buoy (24) and cooperating side walls (21, 22) of said spider buoy and said turret which extend respectively from said top end of said spider buoy and said partition (6) at said bottom end of said turret (14), said connection device (38) between said riser (30) and said pipe (36) being positioned in said enclosed space, a ventilation shaft (32) which is mounted to extend between said enclosed space and a position open to atmosphere, and wherein said pipe (36) extends through a first hole in said partition (6), said ventilation shaft (32) extends through a second hole in said partition (6), and a first seal (56) is placed between said pipe (36) and said first hole and a second seal (56) is placed between said ventilation shaft (52) and said second hole.

2. The improved mooring system of claim 1, wherein;

said improvement further comprises an air line (48) connected to a source of forced air which opens into said enclosed space, said air line having a valve (50) disposed therein for controlling application of ventilating air via said air line (48) into said enclosed space (46).

3. The improved mooring system of claim 1, wherein;

said cooperating side walls (21, 22) of said spider buoy and said partition include a seal (102) disposed between them.

4. The improved mooring system of claim 1, wherein;

said connection device (38) is a quick connect/disconnect connection device, and whereby said turret (14) is releasably connected to said spider buoy (24) by a hydraulic connector.

5. An improved mooring system having an internal turret (14) which is rotatably supported on a vessel and includes a spider buoy (24) arranged and designed for releasable connection to a bottom end of said turret and where said spider buoy carries a riser which is arranged and designed to transport hydrocarbon products from a subsea source of hydrocarbon product to said vessel and where said turret includes a pipe (36) connected to said riser by a coupling, wherein the improvement comprises said spider buoy and said turret are arranged and designed so that when they are connected together, a small volume enclosure is formed around said coupling, said coupling is a quick connect/disconnect coupling (38) which couples a top end of said riser carried by said spider buoy and a bottom end of said pipe coupled to said turret, said enclosure having, a ventilation shaft (52) which extends between said enclosed space and a position open to atmosphere, and an air line (48) connected to a source of forced air which opens into said enclosure, said air line having a valve (50) disposed therein for controlling application of ventilating air via said air line (48) into said enclosure, whereby said small volume enclosure exists about said quick connect/disconnect coupling (38) that can be ventilated with forced air via said air line (48) under normal conditions, and that can be quickly saturated with a gas/air mixture too rich to explode under leakage detection conditions.

6. The improved mooring system of claim 5, wherein;

said spider buoy has an upward facing surface (4) with said riser (30) terminating above said upward facing surface (4), said turret having a downward facing surface (6) with said pipe (36) terminating below said downward facing surface, and wherein, said spider buoy and said turret are arranged and designed so that when coupled together, sufficient height is provided between said upward facing surface (4) of said spider buoy and said downward facing surface (6) of said turret for placement of said quick connect/disconnect coupling (38) for coupling said riser (30) to said pipe (36).

7. The improved mooring system of claim 6, wherein;

said ventilation shaft (52) and said air line (48) are provided through openings in said downward facing surface (6) of said turret (14) and are sealed with respect to said openings to prevent escaping gas from entering into an interior of said turret.

* * * * *